United States Patent [19]

Hirschkoff

[11] 3,964,333

[45] June 22, 1976

[54] SAFETY BRAKING MECHANISM FOR A PORTABLE CHAIN SAW

[75] Inventor: Sidney Hirschkoff, Los Angeles, Calif.

[73] Assignee: McCulloch Corporation, Los Angeles, Calif.

[22] Filed: Oct. 15, 1974

[21] Appl. No.: 515,047

[52] U.S. Cl. ..... 30/381; 192/130

[51] Int. Cl.[2] ..... B25B 7/12

[58] Field of Search ..... 30/381, 383; 188/77 R, 188/166; 192/130, 129 A

[56] References Cited

UNITED STATES PATENTS

| | | | |
|---|---|---|---|
| 3,739,475 | 6/1973 | Moore | 192/130 |
| 3,776,331 | 12/1973 | Gustafsson | 188/77 R |

*Primary Examiner*—James L. Jones, Jr.

*Attorney, Agent, or Firm*—Burns, Doane, Swecker & Mathis

[57] ABSTRACT

A portable chain saw includes a flexible brake band for stopping the cutter chain. A sensing arm is engageable by an arm or hand of an operator to be swung forwardly to tighten the brake band. The sensing arm is continuously biased forwardly to a braking position by a power torsion spring. The same torsion spring also serves to normally hold the sensing arm in a rest position. A latch can be utilized to transmit latching forces from the torsion spring to the sensing arm. Alternatively, the torsion spring itself can serve as a latch to resist forward movement of the sensing arm. The torsion spring is yieldable to enable the sensing arm to be unlatched in response to being struck by the arm or hand of an operator and then swung forwardly by the torsion spring.

14 Claims, 6 Drawing Figures

FIG. 1
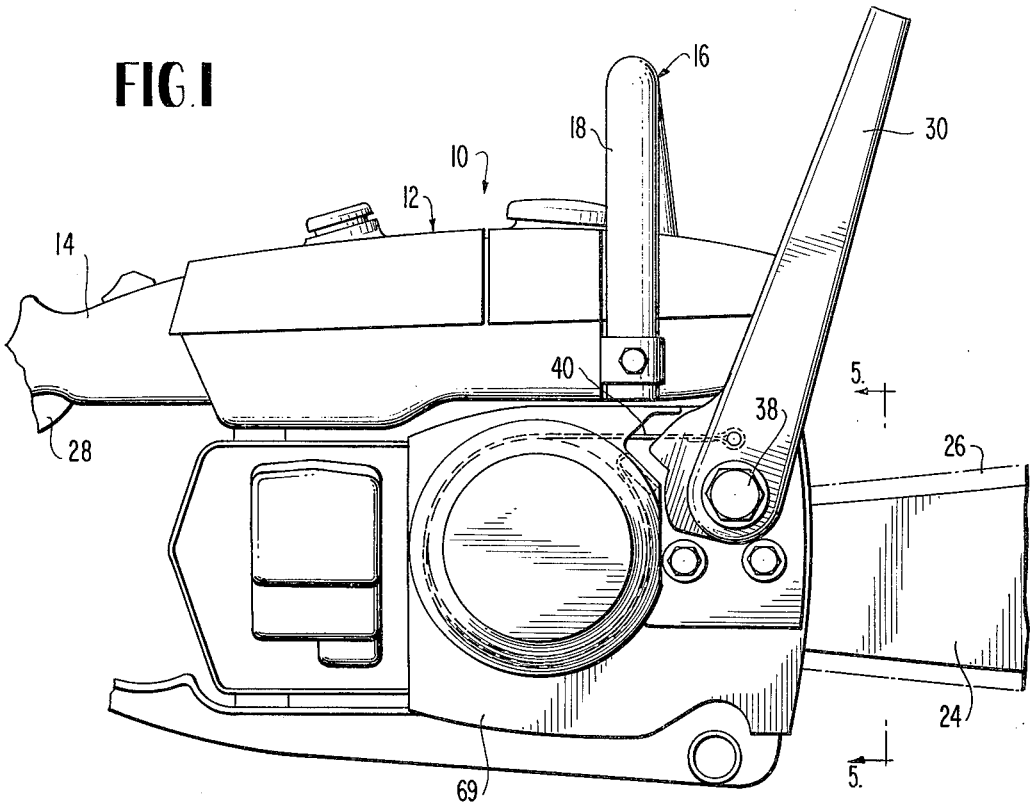
FIG. 2
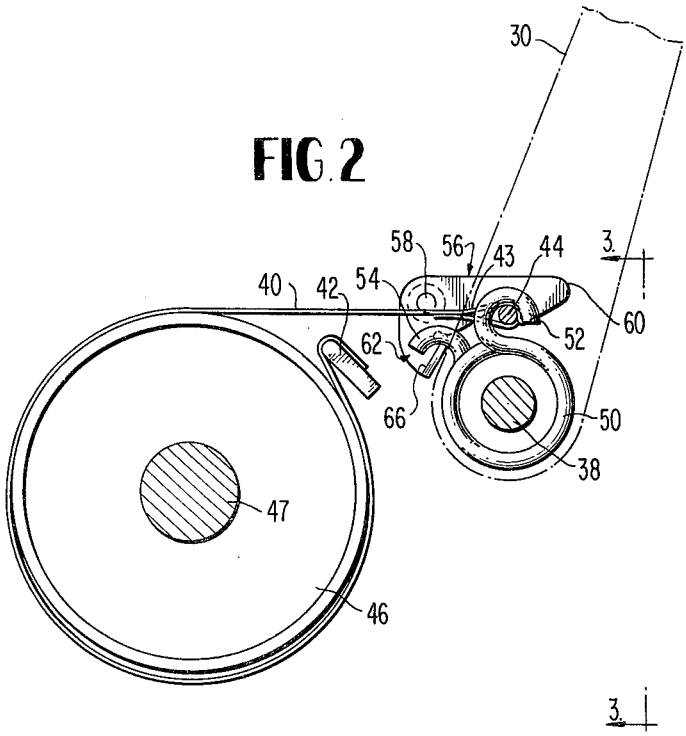
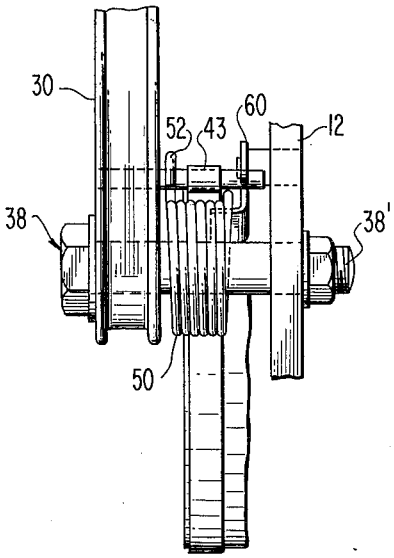
FIG. 3

FIG. 4
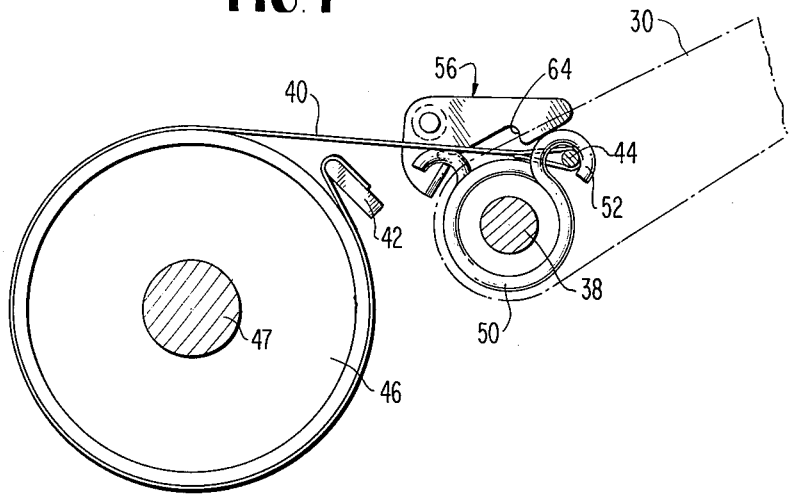
FIG. 5
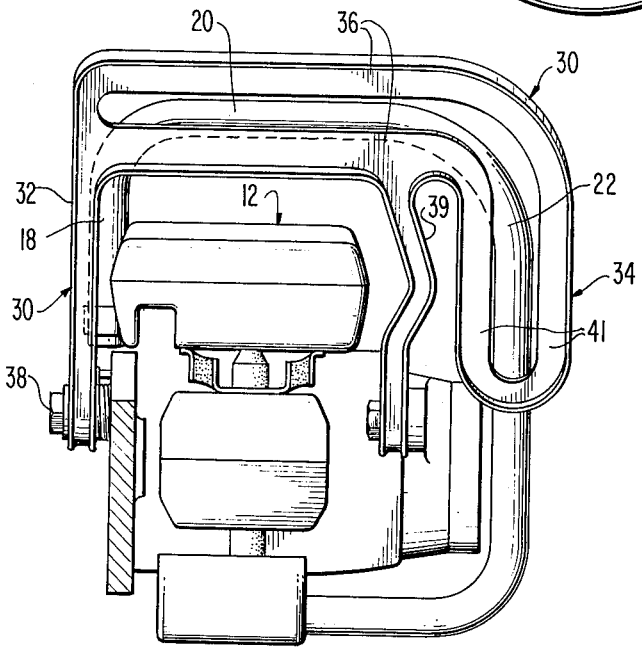
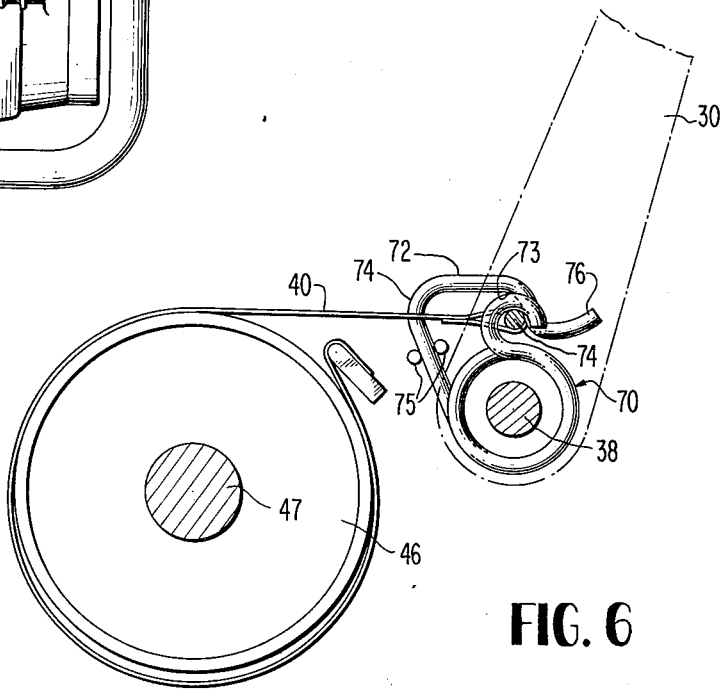
FIG. 6

SAFETY BRAKING MECHANISM FOR A PORTABLE CHAIN SAW

BACKGROUND OF THE INVENTION

This invention relates to a safety mechanism for manually portable chain saws wherein a common spring means serves to concurrently yieldably latch and brakingly bias a chain saw safety handle. More particularly, the invention relates to torsionally activated safety apparatus for minimizing the possibility of a chain saw operator being injured by a cutting chain.

Manually portable chain saws typically comprise an engine-carrying housing, a cutter bar projecting forwardly from the housing, and an engine-driven cutter chain entrained for endless movement around the cutter bar. The chain saw is designed to be utilized by an operator grasping the machine with both hands. An operator's one hand normally holds a gripping handle mounted on the housing, while the other hand engages a housing control handle for actuating a trigger throttle mechanism.

In some instances of cutting operation, the cutting chain may encounter resistance of a type causing the cutter bar to violently kick upwardly in a manner commonly referred to as "kickback." The abrupt action of kickback may cause an operator's hand to slip from the gripping handle and travel toward the cutting chain, or jerk the cutting chain toward the operator's arm or chest.

It has been estimated that approximately 60% of all chain saw related accidents are either directly or ultimately attributable to this kickback phenomenon.

In still other instances of cutting operation wherein an operator applies downward and forward pressure on the gripping handle, there is a possibility of the operator's hand slipping from the gripping handle and traveling toward the cutting chain.

Experience indicates that if an operator's hand does accidentally engage the rapidly moving cutting chain, the hand can be badly mutilated and/or severed.

Proposals have been heretofore offered which have significantly advanced the state of chain saw safety. These proposals are disclosed in Moore U.S. application Ser. No. 109,574, now U.S. Pat. No. 3,739,475, issued June 19, 1973; Moore U.S. application Ser. No. 294,866, now U.S. Pat. No. 3,793,727, issued Feb. 26, 1974; and Dooley U.S. application Ser. No. 354,776, now Pat. No. 3,839,795, issued Oct. 8, 1974, all assigned to the assignee of the present invention. Notwithstanding, however, the significant advancements which these inventions constitute, room for further improvement in the art remains.

Other chain saw safety proposals have been proffered as can be seen, for example, in U.S. Gustafsson Pat. No. 3,776,331, issued Dec. 4, 1973; U.S. Mattsson et al U.S. Pat. No. 3,664,390, issued May 23, 1972; U.S. Irgens Pat. No. 3,361,165, issued Jan. 2, 1965; U.S. Kiekhaefer Pat. No. 2,610,657, issued Sept. 16, 1952; and British Pat. No. 1,351,546, published May 1, 1974.

Among the proposals heretofore made in relation to chain saw safety mechanisms, many involve braking systems which are not capable of imposing sufficient braking forces to stop the cutter chain soon enough. Moreover, the safety systems may be characterized by numerous mechanical components or relatively complicated arrangements, which are not only more expensive to install and more susceptible to failure, but also occupy too much space on a chain saw housing. It will be appreciated, in this connection, that weight and size requirements of a manually portable chain saw dictate that a safety mechanism be effective, yet involve a minimal number of parts that are capable of compact arrangement.

Many of the previously proposed safety proposals require that the operator continually hold an activating lever in retracted position during chain saw operation to prevent activation of a safety brake. It will be apparent that such an arrangement greatly limits the manipulative freedom of the operator who is restricted to gripping the chain saw in a manner suited for retracting the lever.

In maximizing the effectiveness and convenience of chain saw safety mechanism, it is now deemed desirable to provide a torsional chain saw braking apparatus that is capable of exerting each time a strong, torsionally induced and substantially constant braking force, the intensity of which is substantially independent of the manner of actuation. Moreover, such a braking apparatus should be uncomplicated and compact in design so as to exhibit a minimal chance of malfunction as well as occupy little space on the chain saw housing and be multi-functional in nature.

It is, therefore, an object of the invention to alleviate or solve problems of the types discussed above through the use of a compact torsional actuating means.

It is another object of the invention to provide a torsionally actuated chain saw braking mechanism which rapidly and effectively stops a cutter chain in response to the sensing of a dangerous condition and which is uncomplicated and compact in design.

A further object of the invention is to uniquely employ first and second ends of spring means to exert both yieldable latching force and braking movement biasing force on a brake setting, sensing arm.

It is a further object of the invention to provide such a torsional safety braking mechanism which affords significant manipulative freedom for the operator in supporting and guiding the chain saw.

It is still another object of the invention to provide such a safety braking mechanism which is torsionally activated in response to engagement between the hand or arm of an operator and a sensing lever to apply a substantially constant, torsionally induced braking force which is independent of the force with which the operator engages the sensing lever.

It is a further object of the invention to provide such a torsional safety braking mechanism which is fast-acting and which can be conveniently recocked and which entails an unusually effective and compact installation, minimizing alterations of conventional chain saw structure.

BRIEF SUMMARY OF THE PREFERRED EMBODIMENTS OF THE INVENTION

These and other objects are achieved by the present invention in which a manually portable chain saw includes a housing, a manual gripping handle mounted on the housing, an engine carried by the housing, a cutting chain, a support bar projecting forwardly from the housing for supporting the cutting chain for endless movement, a rotation transmission operably connected to the engine for driving the cutting chain, and a safety braking mechanism for stopping the cutting chain. The safety braking mechanism includes a sensing arm which is mounted on the housing for swinging movement. A portion of the sensing arm is located in front of the gripping handle during operation of the chain saw and is arranged to be swung in a first direction in response to being struck by an arm or hand of an operator. A flexible brake band is provided and includes a first end anchored to the housing and a second end coupled to the sensing arm for movement therewith. The arrangement is such that as the arm is swung in the first direction, it shifts the brake band into frictional braking relationship with the rotation transmission to stop the cutting chain.

The improvement in the art resides in the provision of a unique spring arrangement which has first and second ends, where the first spring end is arranged to constantly bias the sensing arm toward the first direction of movement and the second spring end is arranged to impose yieldable latching forces on the sensing arm to resist movement of the sensing arm in the first direction and thereby prevent premature brake activation. The arrangement is optimized by a torsion spring mounted on the pivot axis of the sensing arm.

In one preferred embodiment of the invention, the spring comprises a torsion spring which both biases the sensing arm towards its braking direction as well as biases a latch into latching engagement with the sensing arm to prevent movement of the sensing arm in its braking direction until struck by the arm or hand of an operator.

In another preferred embodiment of the invention, the second end of the torsion spring defines a latch which is movable into latching relationship with the sensing arm to prevent premature movement of the brake into braking relationship with the power transmission. This second spring end, however, is shiftable to an unlatching position in response to movement of the sensing arm in its braking direction so as to allow the torsion spring to shift the brake into braking relationship with the power transmission.

THE DRAWING

Other objects and advantages of the present invention will become apparent from the subsequent detailed description thereof in which like numerals designate like elements, and in which:

FIG. 1 is a side elevational view of a portion of a chain saw in accordance with the present invention;

FIG. 2 is a side view of a safety braking system forming a part of the chain saw, with the braking system being in a non-braking posture;

FIG. 3 is an end view of the safety braking system, viewed along line 3—3 of FIG. 2;

FIG. 4 is a view similar to FIG. 2 depicting the safety braking system in a braking posture;

FIG. 5 is a front view of the chain saw, taken along line 5—5 of FIG. 1; and FIG. 6 is a side view of another embodiment of a safety braking system in a non-braking posture.

DETAILED DESCRIPTION OF PREFERRED EMBODIMENTS OF THE INVENTION

In FIG. 1 there is depicted a preferred form of the invention embodied in a manually portable chain saw. The chain saw 10 includes a housing 12 which carries an internal combustion engine in conventional fashion. The housing 12 includes a control handle 14 mounted at the rear of the housing and a gripping handle 16 mounted near the front of the housing. The gripping handle includes top and side portions 18, 20, 22 (FIG. 5).

A cutter or guide bar 24 projects forwardly from the housing 12 and supports a saw chain or cutter chain 26 for endless movement therearound. The cutter chain is driven by a suitable power transmission from the internal combustion engine. The power transmission per se does not constitute the present invention, hence any suitable conventional power transmission assembly may be utilized, such as those disclosed for example, in U.S. Patents to Moore et al Pat. No. 2,947,399; Collins Pat. No. 3,385,411; and Hazzard Pat. No. 3,425,411, all assigned to the assignee of the present invention and all being incorporated herein by reference.

Usually, the power transmission includes a chain sprocket wheel which is rotated by the engine drive shaft and around which is arranged the cutter chain 26. Rotation of the chain sprocket wheel drives the cutting chain in endless fashion around the cutter bar.

During use of the chain saw 10 an operator typically grasps the control handle 14 with one hand and the gripping handle 16 with the other hand. The gripping handle 16 is primarily used to manipulate and apply pressure to the chain saw, while the control handle 14 is utilized to stabilize the saw and control the rate of travel of the cutting chain through operation of a trigger throttle 28. The operator is able to grasp various portions of the gripping handle 16 in order to properly orient the cutter chain.

As noted earlier, the kickback phenomenon can occur without warning so as to endanger the safety of the operator. In order to minimize this danger, the present invention involves the provision of a chain saw safety system.

In one preferred form the safety system includes a sensing arm 30 which is mounted for swinging movement on the housing. The safety arm is a generally inverted U-shaped member (FIG. 5) having essentially vertically extending side sections 32, 34 and a horizontally extending top section 36. One of the side sections 32 is pivotally mounted to the housing by a pivot 38 in the form of a bolt 38' so that the sensing arm is located in front of the gripping handle 16. The other side portion 34 preferably includes a portion 39 which is also pivoted to the housing, as well as a portion 41 which overlies most of the side 22 of the gripping handle 16.

In short, the sensing arm 30 is arranged to lie between the gripping handle 16 and the cutting chain 26 so as to be engaged by an arm or hand of an operator that approaches too closely the cutter chain. A dangerous condition of this type can occur, for example, should an operator's hand slip from the gripping handle, or if the chain saw kicks back unexpectedly.

In any event, it will be appreciated that the sensing arm is deployed so as to be swung forwardly upon being struck by an operator's arm or hand.

Operably connected to the sensing arm 30 is a brake assembly. The brake assembly includes a flexible brake band 40 which is anchored at one end, by a bracket 42 for example, to the housing 12. The sensing arm 30 includes a flange in the form of a rigid pin 44 to which the other end of the brake band 40, a looped end 43, is attached.

The brake band is disposed around the peripheral surface of a brake drum 46. The brake drum 46 comprises a rotary element that is coupled to the power transmission of the chain saw such that braking forces which are applied to the drum will serve to slow the cutter chain. For example, the drum 46 can be coupled to a shaft 47 driven by the engine, or to a sprocket wheel which drives the cutter chain. Alternatively, in those instances wherein a centrifugal clutch is utilized, such as disclosed in the previously mentioned Moore et al, Collins, and Hazzard patents, the cup of the clutch may advantageously serve as the brake drum.

In any event, as the chain saw engine and power transmission rotate the cutting chain, the drum 46 will also be rotated. Should a braking force be applied to the drum 46, such force will be transmitted in a manner braking the cutter chain. It will be noted, however, that the brake drum is, under normal operating conditions, free-turning and does not interfere with or place limitations upon the cutting chain power transmission.

The sensing arm 30 is rotatable between a rest position (FIG. 2), constituting a normal operating position thereof, and a braking position (FIG. 4) in which the sensing arm has been swung forwardly. In the rest position of the sensing arm, the brake band 40 is in a non-braking posture disposed loosely around the drum 46 so that no braking forces are exerted. In the braking position of the sensing arm, the brake band 40 is in a braking posture, i.e. it has been tightened against the brake drum 46. Thus, the brake band is placed in frictional braking relationship with the power transmission to brake the cutter chain to a halt.

The flexible brake band presents a highly efficient braking element for a chain saw in that, being flexible, it is capable of engaging and exerting frictional forces against a substantial portion of the drum periphery.

In accordance with the present invention, a brake control mechanism is provided to resist swinging movement of the sensing arm during a first control stage and positively swing the sensing arm forwardly during a second control stage.

Preferably, the brake control mechanism includes a spring which both biases the sensing arm 30 toward its braking position and imposes latching forces thereon to hold the sensing arm in its rest position.

In one preferred embodiment, the spring comprises a torsion spring 50 that is mounted coaxially relative to the pivot axis of the sensing arm. This spring 50 includes a brake activating end 52 and a latching end 54. The brake activating end 52 of the torsion spring 50 is hooked around the pin 44 to continuously urge the sensing arm forwardly.

A latch 56 pivotally mounted at 58, intermediate its ends, to the housing 12. The latch includes an arm engaging end 60 and a biased end 62. The arm engaging end 60 includes a notch 64 which is suited for grasping the pin 44 of the sensing arm 30. The biased end 62 of the latch includes a lateral lip 66 which is engaged by the latching end 54 of the torsion spring in a manner which continually urges the latch towards a latching position.

The latch is sufficiently yieldable, in response to the sensing arm 30 being struck by the hand or arm of an operator, to allow the sensing arm to be moved to an unlatching position (FIG. 4). As a result, the arm 30 can be positively swung to its braking position by the brake activating end 52 of the spring.

The spring 50 is of a heavy duty type capable of ramming the sensing arm 30 forwardly and stopping the cutter chain in almost instantaneous fashion.

Recocking of the braking assembly is afforded by manual retraction of the sensing arm 30. In this connection, the latch 56 includes a cam face 68 which is oriented to be engaged by the pin 44, enabling the pin 44 to raise the latch and re-enter the notch 64.

A cover 69 can be disposed over the braking assembly to protect and shield the braking assembly.

In another preferred form of the invention, the torsion spring itself functions as a latch. As is illustrated in FIG. 6, the latching end of a torsion spring 70 assumes an angled configuration and is hooked around the pin 44. More particularly, an angled leg section 72 defines a groove 73 which receives the pin 44. It will be appreciated that, as in the case of the previously disclosed embodiment, the torsion spring both biases the sensing arm 30 toward its braking position and retains the sensing arm in its rest position. In this instance, however, the latching forces are imposed directly on the arm 30 by the spring, rather than indirectly through a separate latch element.

Stop projections 75 are provided on the housing to engage the torsion spring and prevent unwinding thereof.

The latching end of the torsion spring 70 effectively resists the urgings imposed on the sensing arm 30 by the brake activating end of the torsion spring 70 and thus resists movement of the sensing arm toward its braking position. The leg section 72 of the torsion spring 70 is yieldable about its bite portion 74, in response to a striking of the sensing arm 30 by the arm or hand of an operator, to enable the leg 72 to be shifted to an unlatching posture. As a result, the sensing arm 30 will be positively swung forwardly to its braking position under the influence of the brake activating end of the torsion spring 70.

The spring 70 includes a forwardly projecting reset lip 76. When the pin 44 urges itself from the groove 73 and is rammed forwardly by the spring 70, it will run below and along the reset lip 76. During manual retraction of the arm 30, the pin 44 rides along the lip 76 and is thus conveniently returned to the groove 73.

OPERATION

In utilizing the chain saw depicted in FIGS. 1–4, the housing is manually supported and maneuvered by an operator who grasps the control handle 14 and the gripping handle 16. The sensing arm 30 is normally retained in a rest position by the latch 56, the latter being urged to a latching posture by the latching end 54 of the torsion spring 50. In the event that the cutter bar kicks upwardly toward the operator's chest, or that the operator's hand slips from the gripping handle 16, such that the hand or arm of the operator approaches too closely the cutting chain 26, the sensing arm 30 will be struck. When this occurs, the latching end of the spring 50 yields and the latch 56 will be shifted to an unlatching posture (FIG. 4), allowing the sensing arm 30 to be swung forwardly by the biasing action of the torsion spring 50. Thus, the brake band 40 is tightened around the periphery of the brake drum 46 and the cutting chain is brought swiftly to a halt.

It will be understood that once the cutter chain has been halted, and the operator regains a firm grasp of the gripping handle, operation of the chain saw may be resumed by manually retracting the sensing arm 30 so that the pin 44 cams the latch 56 and re-enters the notch 64. As a result, the brake band 40 will be slackened relative to the brake drum and the sensing arm 30 will be effectively recocked (FIG. 2).

Operation of the embodiment disclosed in connection with FIG. 6 is similar to that discussed in relation with the previously discussed embodiment. However, in the FIG. 6 embodiment, the latching end of the torsion spring 70 directly engages and latches the sensing arm 30. Should the sensing arm 30 be struck by the arm or hand of an operator, the latching end of the torsion spring shifts upwardly to an unlatching posture to allow the sensing arm 30 to be rammed forwardly by the torsion spring 70.

Subsequent recocking of the sensing arm 30 is facilitated since the pin 44 rides below the lip 76 of the spring 70. Manual retraction of the spring arm 30 thus enables the pin 44 to easily re-enter the groove 73.

SUMMARY OF MAJOR ADVANTAGES AND SCOPE OF THE INVENTION

It will be apparent that the safety system of the present invention effects rapid stoppage of the cutter chain while affording the operator a great deal of freedom in gripping and manipulating the chain saw at various locations. That is, the operator can grab essentially any portion of the gripping handle while still being protected by the sensing arm which overlies the strategic points of the gripping handle.

The brake is normally held in a non-braking position and is swiftly swung to a braking position by means of a power mechanism that requires few elements and which occupies little space on the housing. Consequently, the mechanism is not susceptible to failure and adds little expense, weight, and size to the chain saw.

These features can be demonstrated by the use, in the preferred embodiments, of a single, compactly arranged torsion spring which both biases the sensing arm to a braking position and retains this arm in its rest posture.

The sensing arm lies in front of top as well as side portions of the gripping handle. Thus, the operator is protected even when grasping a side of the gripping handle.

The use of a flexible brake band is useful in assuring that friction forces are imposed against the brake drum about a substantial portion of its periphery.

The safety mechanism of the present invention can be conveniently reset subsequent to being activated so that little working time is lost.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a manually portable chain saw having housing means; manual gripping handle means mounted on said housing means; engine means carried by said housing means; a cutting chain; support bar means projecting forwardly from said housing means for supporting said cutting chain for endless movement; rotation transmitting means for driving said cutting chain; and safety braking means for stopping said cutting chain, said safety braking means comprising:

sensing arm means mounted on said housing means for swinging movement;

a portion of said sensing arm means being located in front of said gripping handle means during operation of said chain saw and arranged to be swung in a first direction in response to being struck by an arm or hand of an operator;

a flexible brake band including a first end anchored to said housing means and a second end coupled to said sensing arm means for movement therewith such that as said arm means is swung in said first direction, it shifts said brake band into frictional braking relationship with said rotation transmitting means to stop said cutting chain; and a spring having first and second ends;

said first spring end being arranged to constantly bias said sensing arm means toward said first direction of movement; and said second spring end being arranged to impose yieldable latching forces on said sensing arm means to resist movement of said sensing arm means in said first direction and thereby prevent premature brake activation.

2. In a manually portable chain saw having housing means; manual gripping handle means mounted on said housing means; engine means carried by said housing means; a saw chain; support bar means projecting forwardly from said housing means for supporting said saw chain for endless movement; rotation transmitting means operably connected to said engine means for driving said saw chan; and safety braking means for braking said saw chain, said safety braking means comprising:

sensing arm means pivotally mounted on said housing means;

said sensing arm means being arranged to swing in a first direction in response to being engaged by an arm or hand of an operator;

brake means movably mounted on said housing means and being operably connected to said sensing arm means to be shifted into frictional braking relationship with said rotation transmitting means in response to swinging of said arm means in said first direction;

a torsion spring having first and second ends;

said first spring end being arranged to constantly bias said sensing arm means toward said first direction of movement; and said second spring end being arranged to impose yieldable latching forces on said sensing arm means to resist movement of said sensing arm means and thereby prevent premature brake activation.

3. A chain saw according to claim 2 wherein said safety braking means further comprises latch means movable between a latching position preventing movement of said sensing arm means in said first direction of movement, and an unlatching position allowing movement of said arm means in said first direction of movement;

said second end of said torsion spring means being arranged to bias said latch means into its latching position;

said latch means being movable to its unlatching position, against the bias of said torsion spring means, in response to movement of said sensing arm means in said first direction to enable said torsion spring means to positively shift said brake means into braking contact with said rotation transmission means. chain,

4. A chain saw according to claim 2 wherein said second end of said torsion spring means defines a latch movable to a latching relationship with said sensing arm means, wherein movement of said sensing arm is resisted to prevent premature movement of said brake means into braking contact with said rotation transmission means; said second spring end being shiftable to an unlatching position, in response to movement of said sensing arm means in said first direction, so as to allow said torsion spring means to shift said brake means into braking contact with said rotation transmission means.

5. In a manually portable chain saw having housing means; manual gripping handle means mounted on said housing means; engine means carried by said housing means; a cutting chain; support bar means projecting forwardly from said housing means for supporting said cutting chain for endless movement; rotation transmitting means operably connected to said engine means for driving said cutting chain; and safety braking means for stopping said cutting chan,' said safety braking means comprising:

a sensing arm pivotally mounted to said housing means;

said sensing arm being located in front of said gripping handle means and being arranged to be engaged and pivoted forwardly from a rest position toward a braking position by an arm or hand of an operator that too closely approaches said cutting chain;

a flexible brake band connected at one end of said housing means and at another end to said sensing arm;

said brake band extending around a brake drum portion of said rotation transmitting means such that forward pivotal movement of said sensing arm toward said braking position tightens said brake band against said brake drum portion to frictionally brake said power transmitting means; and brake control means comprising:

a torsion spring having first and second ends, said first end of said torsion spring engaging said sensing arm in a manner continuously urging said arm forwardly, and a latch engaged and biased by said second end of said torsion spring; said latch being movable between:

a latching position wherein said latch is biased by said torsion spring into latching engagement with said sensing arm, when said sensing arm is in said rest position, to resist forward pivotal movement of said sensing arm, and an unlatching position wherein said latch is shifted forwardly in response to engagement of said sensing arm by an arm or hand of an operator, to allow forward pivotal movement of said sensing arm toward said braking position under the urging of said torsion spring to stop said cutting chain.

6. A chain saw according to claim 5 wherein said sensing arm includes a flange, said torsion spring being coiled coaxially relative to the pivot axis of said sensing arm, with said first end of said torsion spring engaging said flange and said second end of said torsion spring biasing said latch into engagement with said flange.

7. A chain saw according to claim 6 wherein said latch is pivoted to said housing means intermediate its ends; one end of said latch including a notch for receiving said flange; the other end of said latch having a lateral lip engaged by said second end of said torsion spring.

8. A chain saw according to claim 5 wherein said sensing arm comprises a generally vertically extending first side section having a lower end pivoted to one side portion of said housing means and extending in front of a first vertical section of said gripping handle means; a generally horizontally extending top section extending in front of a horizontal portion of said gripping handle means, and a generally vertically extending second side section having a portion pivotally connected to said housing means and another portion extending in front of a second vertically extending portion of said gripping handle means.

9. In a manually portable chain saw having housing means; manual gripping handle means mounted on said housing means; engine means carried by said housing means; a cutting chain; support bar means projecting forwardly from said housing means for supporting said cutting chain for endless movement; rotation transmitting means for driving said cutting chain; and safety braking means for stopping said cutting chain, said safety braking means comprising:

a sensing arm pivotally mounted to said housing means;

said sensing arm being located in front of said gripping handle means and being arranged to be engaged and pivoted forwardly from a rest position toward a braking position by an arm or hand of an operator that too closely approaches said cutting chain;

a flexible brake band connected at one end to said housing means and at another end to said sensing arm;

said brake band extending around a brake drum portion of said rotation transmitting means such that forward pivotal movement of said sensing arm toward said braking position tightens said brake band against said brake drum portion to frictionally brake said rotation transmitting means; and brake control means comprising a torsion spring having first and second ends:

said first end of said torsion spring engaging said sensing arm in a manner continuously urging said arm forwardly, and said second end defining a latch which engages said sensing arm when said sensing arm is in a rest position to resist forward pivotal movement of said sensing arm;

said second end being yieldably shiftable to an unlatching position in response to engagement of said sensing arm by an arm or hand of an operator, to allow forward pivotal movement of said sensing arm toward said braking position under the urging of said torsion spring to stop said cutter chain.

10. A chain saw according to claim 9 wherein said sensing arm means includes a flange, said torsion spring being coiled coaxially relative to the pivot axis of said arm means, with said first end of said torsion spring engaging said flange and said second end of said torsion spring including an elongated portion yieldably engageable with said flange.

11. A chain saw according to claim 10 including a stop projection fixed to said housing means, said torsion spring engaging said projection to prevent unwinding thereof.

12. In a manually portable chain saw having housing means; manual gripping handle means mounted on said housing means; engine means carried by said housing means; a saw chain; support bar means projecting forwardly from said housing means for supporting said saw chain for endless movement; rotation transmitting means operably connected to said engine means for driving said saw chain; and safety braking means for stopping said saw chain, said safety braking means comprising:

a sensing arm pivotally mounted on said housing means;

said sensing arm arranged to be pivoted forwardly in response to being engaged by an arm or hand of an operator;

brake means movably mounted on said housing means and arranged to be shifted into frictional braking relationship with said rotation transmitting means;

a torsion spring having first and second ends;

said first end being arranged to constantly bias said brake means toward braking contact with said rotation transmitting means to stop said saw chain; and latch means movable between a latching position preventing movement of said brake means into braking contact with said power transmission means, and an unlatching position allowing movement of said brake means into braking contact with said power transmission means;

said second end of said torsion spring being arranged to engage and bias said latch means toward its latching position;

said latch means being movable to its unlatching position, against the bias of said spring, by forward movement of said arm means to enable said torsion spring to positively swing said brake means into braking contact with said power transmission means.

13. In a manually portable chain saw having housing means; manual gripping handle means mounted on said housing means; engine means carried by said housing means; a saw chain; support bar means projecting forwardly from said housing means for supporting said saw chain for endless movement; rotation transmitting means operably connected to said engine means for driving said saw chain; and safety braking means for stopping said saw chain, said safety braking means comprising:

a sensing arm pivotally mounted on said housing means;

said sensing arm arranged to be pivoted forwardly in response to being engaged by an arm or hand of an operator;

brake means movably mounted on said housing means and arranged to be shifted into frictional braking relationship with said rotation transmitting means;

a torsion spring having first and second ends;

said first end being arranged to constantly bias said brake means toward braking contact with said rotation transmitting means to stop said saw chain; and said second end defining a latch movable into a latching position to resist premature movement of said brake means into braking relationship with said rotation transmission means;

said second end being shiftable to an unlatching position, upon forward movement of said arm means, allowing said spring to shift said brake means into braking contact with said rotation transmission means.

14. In a manually portable chain saw having housing means; manual gripping handle means mounted on said housing means, said gripping handle means including a top portion extending along a top section of said housing means and first and second side portions extending along first and second side sections of said housing means; engine means carried by said housing means; a cutting chain; support bar means projecting forwardly from said housing means for supporting said cutting chain for endless movement; rotation transmitting means operably connected to said engine for driving said cutting chain; and safety braking means for stopping said cutting chain, said safety braking means comprising:

brake means movable between a non-braking position and a braking position:

said brake means being arranged, in its braking position, to stop said cutting chain;

sensing arm means pivotally mounted to said housing means and being forwardly pivotally movable in response to being struck by an arm or hand of an operator;

said sensing arm means being operably connected to said brake means to shift said brake means to its braking position when said sensing arm means is pivoted forwardly;

said sensing arm means comprising:

a top part extending along said top section of said housing means in front of said top portion of said gripping handle means, a first side part pivotally connected to said first side section of houisng means at a point substantially below said top section of said housing means by a first pivot connection and extending along said first housing side section in front of said first side portion of said gripping handle means, and a second side part having one portion thereof extending along and in front of said second side portion of said gripping handle means and having another spaced portion thereof pivotally connected to said second housing side section by a second pivot connection coaxial relative to said first pivot connection, said one portion terminating just short of the axis defined by said first and second pivot connections, such that said top and side portions of said gripping handle means are protected by said sensing arm.

* * * * *